US007121698B1

(12) United States Patent
Johnson

(10) Patent No.: US 7,121,698 B1
(45) Date of Patent: Oct. 17, 2006

(54) PORTABLE HANGING LIGHT WITH A MAGNETIC HOLDING STRIP

(76) Inventor: Jerry P. Johnson, Route 2 Box 217 A12, Kosciusko, MS (US) 39090

( * ) Notice: Subject to any disclaimer, the term of this patent is extended or adjusted under 35 U.S.C. 154(b) by 17 days.

(21) Appl. No.: 10/938,640

(22) Filed: Sep. 13, 2004

(51) Int. Cl.
*F21V 21/00* (2006.01)

(52) U.S. Cl. ..... 362/396; 362/223; 362/220; 362/250

(58) Field of Classification Search ..... 362/396
See application file for complete search history.

(56) References Cited

U.S. PATENT DOCUMENTS

| | | | | |
|---|---|---|---|---|
| 3,593,016 | A | 7/1971 | Gerdel | |
| 4,564,894 | A | 1/1986 | Gonzalez | |
| 4,782,432 | A | 11/1988 | Coffman | |
| 4,816,969 | A * | 3/1989 | Miller | 362/282 |
| D331,634 | S | 12/1992 | Browne | |
| 5,416,685 | A | 5/1995 | Myers | |
| 5,490,050 | A | 2/1996 | Clark et al. | |
| 5,528,477 | A * | 6/1996 | Carmo | 362/396 |
| 5,921,658 | A * | 7/1999 | Kovacik et al. | 362/396 |
| 6,663,265 | B1 * | 12/2003 | Kovacik et al. | 362/396 |
| 2003/0026099 | A1 * | 2/2003 | Dutka et al. | 362/322 |

* cited by examiner

*Primary Examiner*—Ali Alavi
*Assistant Examiner*—William J Carter

(57) ABSTRACT

A portable hanging light includes a portable housing that has a plurality of integral walls defining a plurality of partitions formed therein and an adjustably positionable lens. The light further includes a plurality of light-emitting sources housed within one partition and a plurality of control switches spaced along the housing. A plurality of hook members are secured to selected portions of the housing to assist in maintaining the light at a substantially stable position. One of the hook members is disposed along the axis and another of the hook members is resiliently connected to one of the housing walls along a rear portion thereof. At least one power cord adapter is electrically coupled to the switches for allowing a user to electrically connect the light to alternate ones of the external power sources.

15 Claims, 4 Drawing Sheets

PORTABLE HANGING LIGHT WITH A MAGNETIC HOLDING STRIP

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a portable light and, more particularly, to a portable hanging light with a magnetic holding strip.

2. Prior Art

Portable lights which can be manually moved and suspended about a work site to aid a user in obtaining the best lighting conditions are well known. It has been the practice to use incandescent light bulbs, suitably encased in light guards, for this purpose. Such lights are often referred to as trouble lamps, extension lights, work lights, inspection lights, and the like, and are commonly employed by mechanics and other workers who require a concentration of lights in a frequently changing location.

While utility lamps or so-called "trouble lights" are in widespread use, there are still some persistent problems with such lamps which have not had entirely satisfactory solutions. The great majority of utility lamps have hooks by which they may be hung while in use, but many situations occur in which there is no suitable support in the use environment for a hook of the size provided, or for supporting any hook. If the use environment does include a suitable support for hanging the utility lamp by a hook, that support is often not close enough to the work region in need of illumination. Once a utility lamp is hung by an integral hook, its orientation is more or less fixed by the orientation of its support, and that orientation may not be the best for illuminating the desired work region. These problems often occur during the maintenance or repair of automobiles and industrial equipment.

In addition to spot and floodlighting, a strobe light also is desirable for incorporation into a trouble light. In the event of emergencies or when signaling is desired, the activation of a strobe light is quite advantageous, especially at night time when visibility is poor. The strobe effect allows emergency personnel to easily locate and assist the individual(s) in need.

Accordingly, a need remains for a portable hanging light with a magnetic holding strip in order to overcome the above-noted shortcomings. The present invention satisfies such a need by providing a light that is easy and convenient to use, improves user safety through improved lighting, and is advantageously versatile in use. Such a light can be securely fastened to a multitude of surfaces by hooks and/or magnetic strip. This feature conveniently allows optimum illumination of the individual's work area. Furthermore, the trouble light can be attached to either a 12 volt direct current (DC) source or a 110 volt alternating current (AC) source advantageously allowing it to be adapted to the most readily available power source.

BRIEF SUMMARY OF THE INVENTION

In view of the foregoing background, it is therefore an object of the present invention to provide a portable hanging light with a magnetic holding strip. These and other objects, features, and advantages of the invention are provided by a hand-operable apparatus for illuminating a selected work space.

The apparatus including a portable housing that has a centrally disposed longitudinal axis and a plurality of integral walls sized and shaped for defining a plurality of partitions axially formed within the housing. Such a housing further includes an adjustably positionable lens for conveniently allowing a user to selectively filter a luminescence intensity emitting outwardly from one of the partitions. The lens is preferably bifurcated and includes integrally connected surfaces diametrically offset from each other. Such a lens further includes a lever extending outwardly therefrom for conveniently allowing a user to readily position the lens along a selected arcuate path about the axis and adjust the luminescence intensity emitted from the apparatus. The one partition extends along a length of the housing substantially parallel to the axis.

A plurality of light-emitting sources are housed within the one partition and electrically coupled to an external power source. Furthermore, a plurality of control switches are spaced along the housing and operably connected to the light-emitting sources so that a user can advantageously manually toggle the apparatus between various operating modes.

A plurality of hook members are secured to selected portions of the housing and are removably engageable with a support surface for conveniently assisting to maintain the apparatus at a substantially stable position. One of the hook members is disposed along the axis and another of the hook members is resiliently connected to one of the housing walls along a rear portion thereof for providing axial and lateral support axes respectively. Such a hook member is anterior of the one partition for allowing the housing to be maintained along a selected plane obliquely offset from the axis. Another one of the hook members may be adjustably connected to the housing so that a user can advantageously swivel the housing along a radial path.

At least one power cord adapter is electrically coupled to the switches for advantageously allowing a user to electrically connect the apparatus to alternate ones of the external power sources. Such a power cord adapter preferably includes a power cord selected from the group including a 110-volt power cord, a 12-volt cigarette lighter power cord, a vehicle battery power cord adapter provided with a plurality of conductive clamps engageable with positive and negative battery terminals respectively, and any combination of the power cords.

The apparatus preferably further includes an elongated handle integral with the housing and axially extending downwardly and away therefrom for providing a surface onto which a user may conveniently grip the apparatus when transporting the housing between remote locations. Such a handle is provided with a conduit axially formed therein and in fluid communication with another of the partitions for directing at least one power cord adapter upwardly towards the light-emitting sources. The apparatus may further include a magnetic strip inconspicuously positioned within another housing wall so that a user can conveniently removably position the apparatus at an elevated position without employing the hook members.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
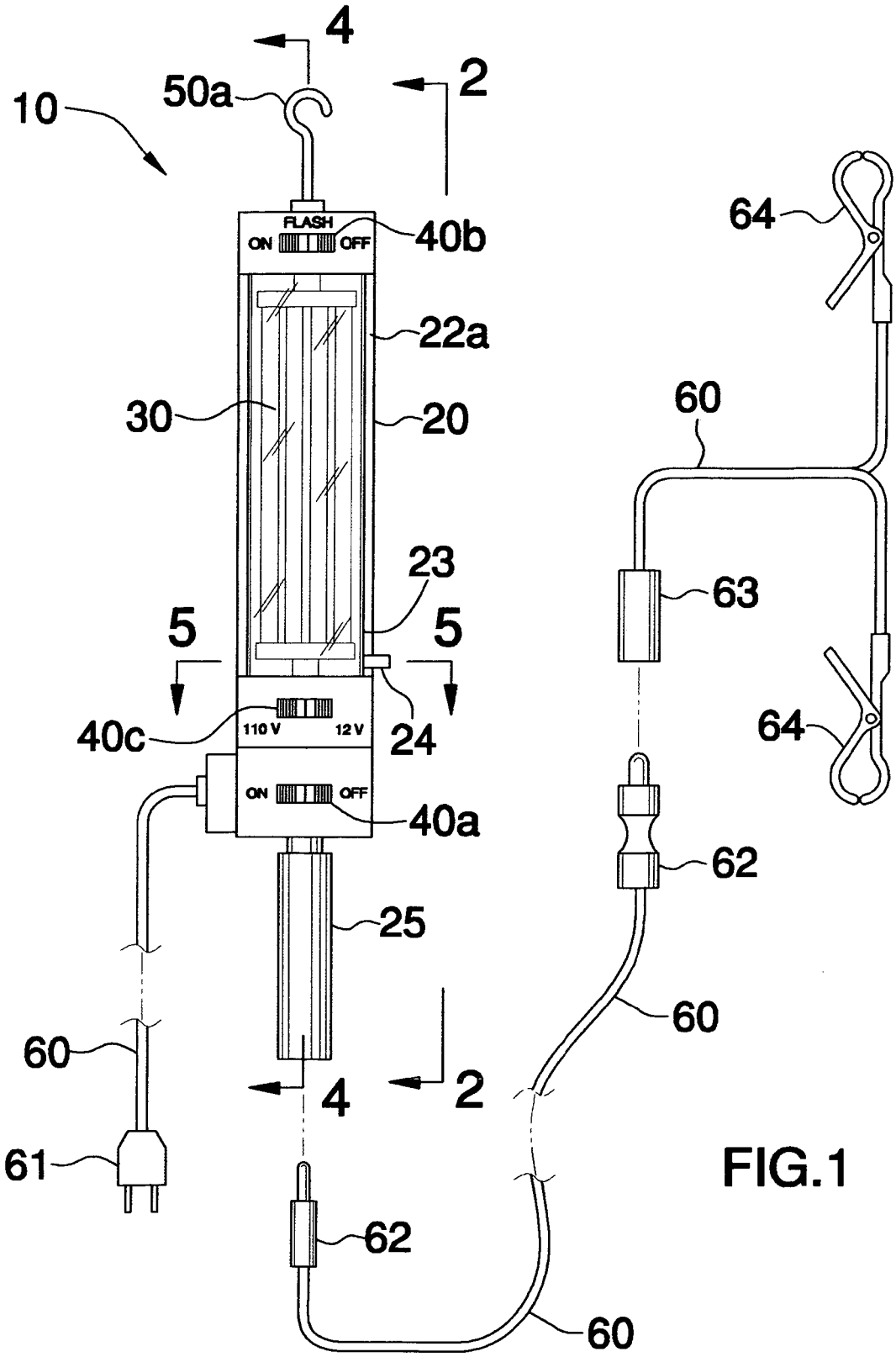
FIG. 1 is a front elevational view showing an apparatus for a portable hanging light with a magnetic holding strip, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–5 by the reference numeral 10 and is intended to provide a portable hanging light with a magnetic holding strip. It should be understood that the apparatus 10 may be used to illuminate many different types of workspaces and should not be limited to use in only automobile repair settings.

Figure 5:
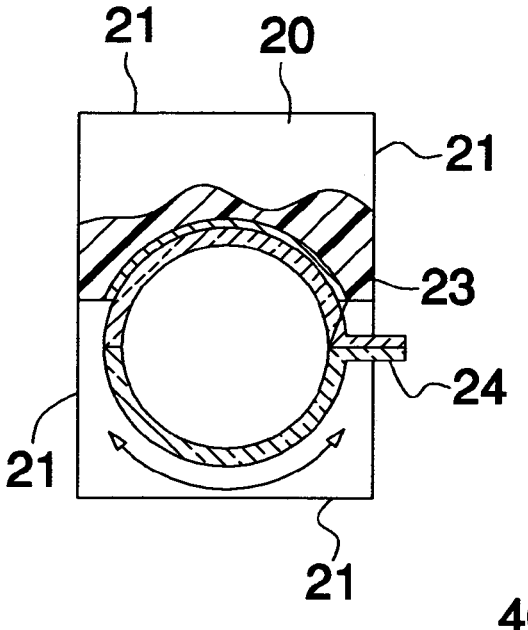
FIG. 5 is a cross-sectional view of the apparatus shown in FIG. 1, taken along line 5—5.

Referring initially to FIG. 1, the apparatus 10 includes a portable housing 20 that has a centrally disposed longitudinal axis and a plurality of integral walls 21 sized and shaped for defining a plurality of partitions 22 axially formed within the housing 20. Such a housing 20 further includes an adjustably positionable lens 23 for conveniently allowing a user to selectively filter a luminescence intensity emitting outwardly from one of the partitions 22*a*. The lens 23 is bifurcated and includes integrally connected surfaces diametrically offset from each other. Such a lens 23 further includes a lever 24 extending outwardly therefrom for conveniently allowing a user to readily position the lens along a selected arcuate path about the axis and adjust the luminescence intensity emitted from the apparatus 10 as shown in FIG. 5. This feature advantageously allows an individual to control the intensity of the light according to the needs of the task they must perform. The one partition 22*a* extends along a length of the housing 10 substantially parallel to the axis.

Figure 2:
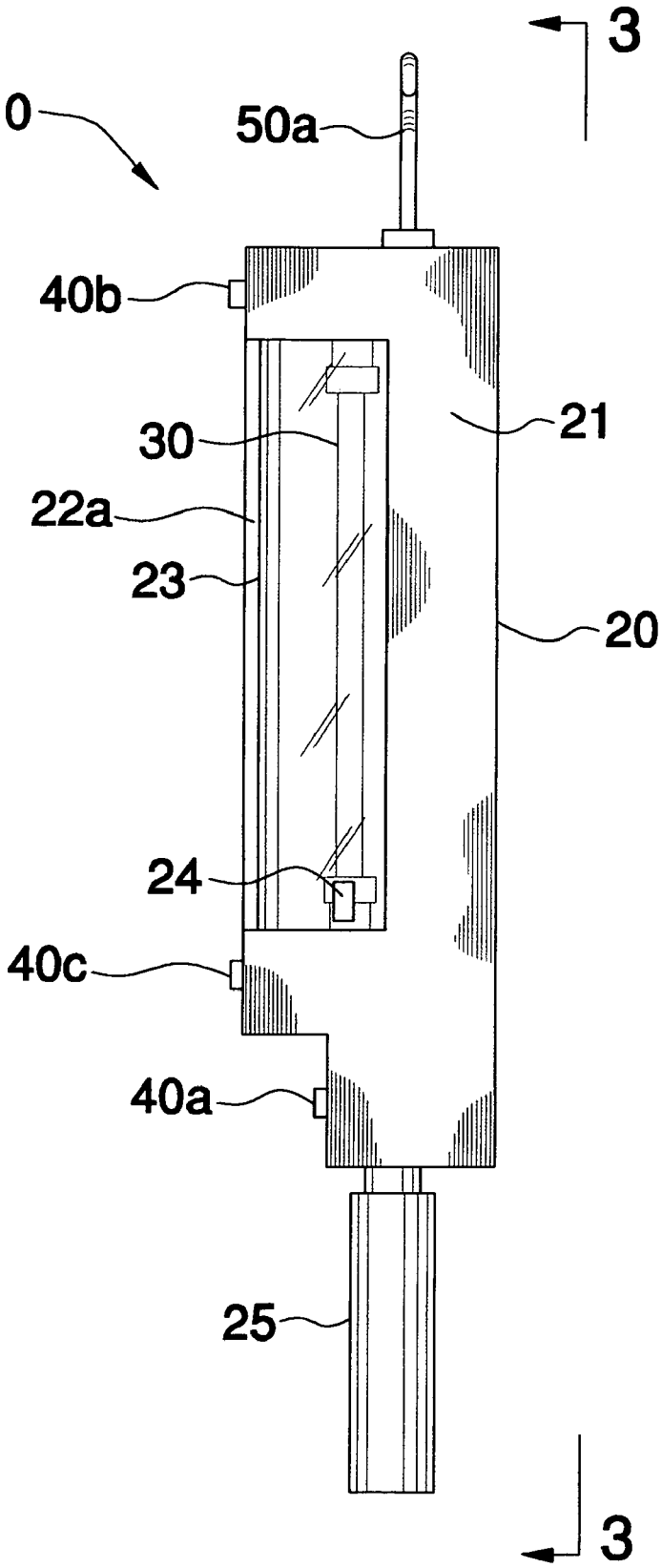
FIG. 2 is a side elevational view of the apparatus shown in FIG. 1.
Figure 4:
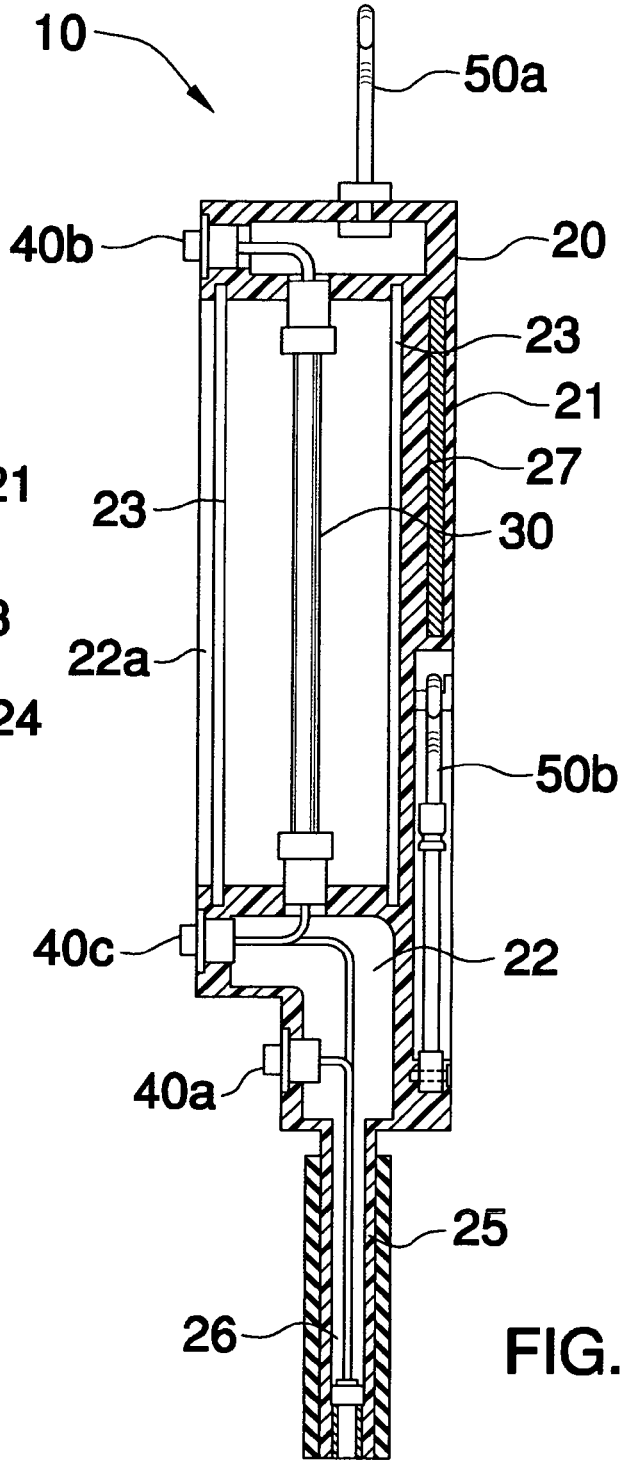
FIG. 4 is a cross-sectional view of the apparatus shown in FIG. 1, taken along line 4—4.

Referring to FIGS. 1, 2 and 4, a plurality of light-emitting sources 30 are housed within the one partition 22*a* and electrically coupled to an external power source. Such light emitting sources 30 include fluorescent bulbs and may also include incandescent type bulbs, as well known in the industry. Furthermore, a plurality of control switches 40 are spaced along the housing 20 and operably connected to the light-emitting sources 30 so that a user can advantageously manually toggle the apparatus 10 between various operating modes. One such switch 40*a* toggles the apparatus 10 between operating and non-operating modes and another switch 40*b* alternates the constancy of the light emitting source 30 between flashing and non-flashing modes. The apparatus 10 further includes a switch 40*c* that advantageously toggles the apparatus between 12 volt direct current (DC) and 110 volt alternating current (AC) operating modes, conveniently allowing the apparatus 10 to adjust to the most readily available power source.

Figure 3:
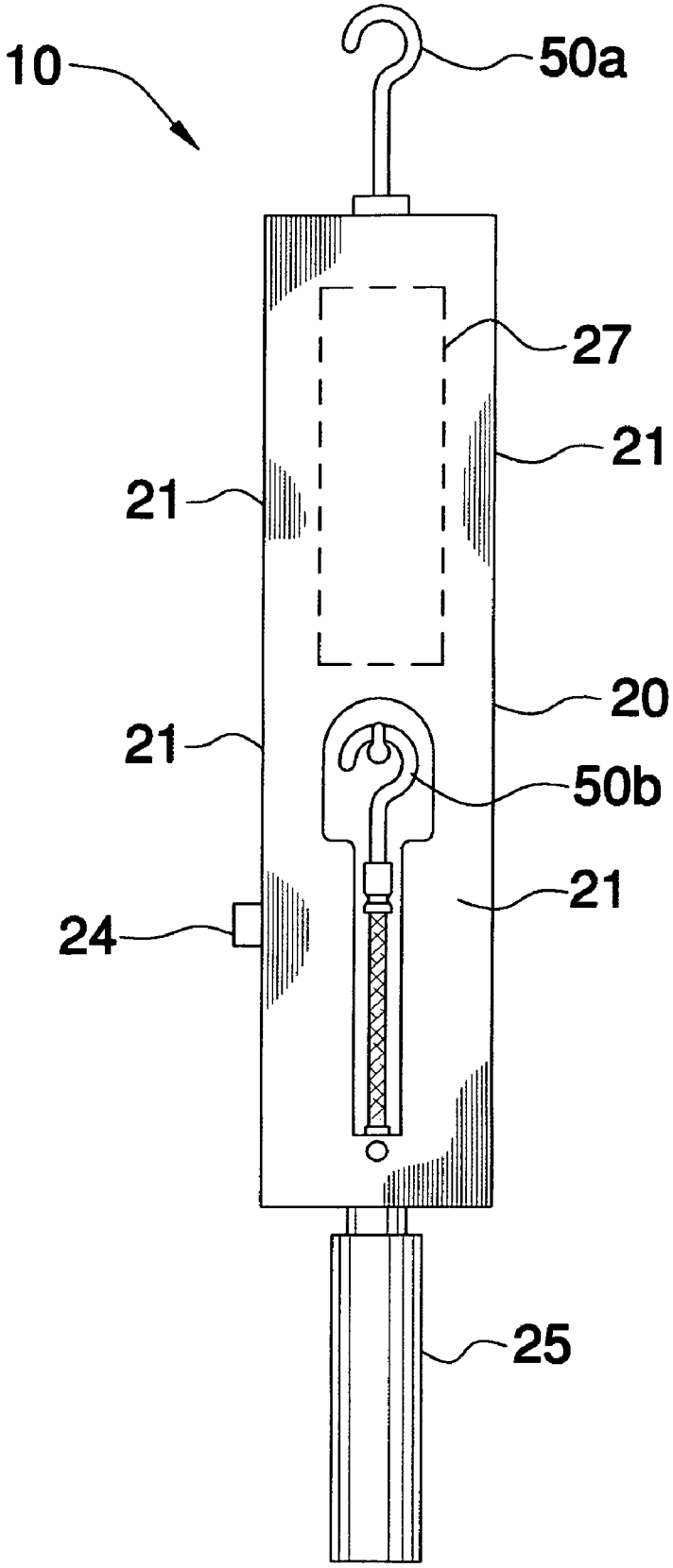
FIG. 3 is a rear elevational view of the apparatus shown in FIG. 1 showing the rear portion hook member.

Referring to FIGS. 1 and 3, a plurality of hook members 50 are secured to selected portions of the housing 20 and are removably engageable with a support surface for conveniently assisting to maintain the apparatus 10 at a substantially stable position. One of the hook members 50*a* is disposed along the axis and another of the hook members 50*b* is resiliently connected to one of the housing walls 21 along a rear portion thereof for providing axial and lateral support axes respectively. Such a hook member 50*b* is anterior of the one partition 22 for allowing the housing 20 to be maintained along a selected plane obliquely offset from the axis. Another one of the hook members 50*a* is adjustably connected to the housing 20 so that a user can advantageously swivel the housing 20 along a radial path. The placement of the hook members 50 at their respective positions advantageously allows the apparatus 10 to be suspended in a multitude of positions ranging from hanging vertically by one hook member 50*a* to being suspended horizontally by using both hook members 50*a, b*. This allows for better illumination of the user's work space than would ordinarily be possible with a conventional trouble light.

Referring to FIG. 1, at least one power cord adapter 60 is electrically coupled to the switches 40 for advantageously allowing a user to electrically connect the apparatus 10 to alternate ones of the external power sources. Such a power cord adapter 60 includes a power cord selected from the group including a 110-volt power cord 61, a 12-volt cigarette lighter power cord 62, a vehicle battery power cord adapter 63 provided with a plurality of conductive clamps 64 engageable with positive and negative battery terminals (not shown) respectively, and any combination of the power cords 61, 62, and 63.

Referring to FIGS. 1–4, the apparatus 10 further includes an elongated handle 25 integral with the housing 20 and axially extending downwardly and away therefrom for providing a surface onto which a user may conveniently grip the apparatus 10 when transporting the housing 20 between remote locations. Such a handle 25 is provided with a conduit 26 axially formed therein and in fluid communication with another of the partitions for directing at least one power cord adapter 60 upwardly towards the light-emitting sources 30. The apparatus 10 further includes a magnetic strip 27 inconspicuously positioned within another housing wall 21 so that a user can conveniently removably position the apparatus 10 at an elevated position without employing the hook members 50 as shown in FIG. 4. Such a magnetic strip 27 improves the versatility of the apparatus 10, especially during working conditions where an adequate surface is not available to suspend the apparatus 10 by means of the hook members 50.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. An apparatus for illuminating a selected work space, said apparatus comprising:

a portable housing having a centrally disposed longitudinal axis and a plurality of integral walls defining a plurality of partitions axially formed within said housing, said housing further including an adjustably positionable lens for allowing a user to selectively filter a luminescence intensity emitted from said apparatus;

a plurality of light-emitting sources housed within said one partition and electrically coupled to an external power source;

a plurality of control switches spaced along said housing and operably connected to said light-emitting sources so that a user can manually toggle said apparatus between various operating modes;

a plurality of hook members secured to selected portions of said housing and being removably engageable with a support surface for assisting to maintain said apparatus at a substantially stable position, one said hook members being disposed along the axis and another of said hook members being resiliently connected to one said housing walls along a rear portion thereof for providing axial and lateral support axes respectively, said hook member allowing said housing to be maintained along a selected plane obliquely offset from the axis; and at least one power cord adapter electrically coupled to said switches for allowing a user to electrically connect said apparatus to alternate ones of the external power sources;

wherein said lens is bifurcated and includes integrally connected surfaces diametrically offset from each other, said lens further includes a lever extending outwardly therefrom for allowing a user to readily position said lens along a selected arcuate path about the axis and adjust the luminescence intensity emitted from said apparatus.

2. The apparatus of claim 1, further comprising: an elongated handle integral with said housing and axially extending downwardly and away therefrom for providing a surface onto which a user may grip said apparatus when transporting said housing between remote locations, said handle being provided with a conduit axially formed therein and in fluid communication with another of said partitions for directing said at least one power cord adapter upwardly towards said light-emitting sources.

3. The apparatus of claim 1, further comprising: a magnetic strip inconspicuously positioned within another said housing wall so that a user can removably position said apparatus at an elevated position without employing at least one of said hook members.

4. The apparatus of claim 1, wherein said at least one power cord adapter comprises: a power cord selected from the group including a 110-volt power cord, a 12-volt cigarette lighter power cord, a vehicle battery power cord adapter provided with a plurality of conductive clamps engageable with positive and negative battery terminals respectively, and any combination of said power cords.

5. The apparatus of claim 1, wherein one of said hook members is adjustably connected to said housing so that a user can swivel said housing along a radial path.

6. A hand-operable apparatus for illuminating a selected work space, said apparatus comprising:

a portable housing having a centrally disposed longitudinal axis and a plurality of integral walls defining a plurality of partitions axially formed within said housing, said housing further including an adjustably positionable lens for allowing a user to selectively filter a luminescence intensity emitted from said apparatus, said one partition extending along a length of the housing substantially parallel to the axis;

a plurality of light-emitting sources housed within said one partition and electrically coupled to an external power source;

a plurality of control switches spaced along said housing and operably connected to said light-emitting sources so that a user can manually toggle said apparatus between various operating modes;

a plurality of hook members secured to selected portions of said housing and being removably engageable with a support surface for assisting to maintain said apparatus at a substantially stable position, one said hook members being disposed along the axis and another of said hook members being resiliently connected to one said housing walls along a rear portion thereof for providing axial and lateral support axes respectively, said hook member allowing said housing to be maintained along a selected plane obliquely offset from the axis; and at least one power cord adapter electrically coupled to said switches for allowing a user to electrically connect said apparatus to alternate ones of the external power sources;

wherein said lens is bifurcated and includes integrally connected surfaces diametrically offset from each other, said lens further includes a lever extending outwardly therefrom for allowing a user to readily position said lens along a selected arcuate path about the axis and adjust the luminescence intensity emitted from said apparatus.

7. The apparatus of claim 6, further comprising: an elongated handle integral with said housing and axially extending downwardly and away therefrom for providing a surface onto which a user may grip said apparatus when transporting said housing between remote locations, said handle being provided with a conduit axially formed therein and in fluid communication with another of said partitions for directing said at least one power cord adapter upwardly towards said light-emitting sources.

8. The apparatus of claim 6, further comprising: a magnetic strip inconspicuously positioned within another said housing wall so that a user can removably position said apparatus at an elevated position without employing at least one of said hook members.

9. The apparatus of claim 6, wherein said at least one power cord adapter comprises: a power cord selected from the group including a 110-volt power cord, a 12-volt cigarette lighter power cord, a vehicle battery power cord adapter provided with a plurality of conductive clamps engageable with positive and negative battery terminals respectively, and any combination of said power cords.

10. The apparatus of claim 6, wherein one of said hook members is adjustably connected to said housing so that a user can swivel said housing along a radial path.

11. A hand-operable apparatus for illuminating a selected work space, said apparatus comprising:

a portable housing having a centrally disposed longitudinal axis and a plurality of integral walls defining a plurality of partitions axially formed within said housing, said housing further including an adjustably positionable lens for allowing a user to selectively filter a luminescence intensity emitted from said apparatus, said one partition extending along a length of the housing substantially parallel to the axis;

a plurality of light-emitting sources housed within said one partition and electrically coupled to an external power source;

a plurality of control switches spaced along said housing and operably connected to said light-emitting sources so that a user can manually toggle said apparatus between various operating modes;

a plurality of hook members secured to selected portions of said housing and being removably engageable with a support surface for assisting to maintain said apparatus at a substantially stable position, one said hook members being disposed along the axis and another of said hook members being resiliently connected to one said housing walls along a rear portion thereof for providing axial and lateral support axes respectively, said one hook member being anterior of said one partition and for allowing said housing to be maintained along a selected plane obliquely offset from the axis; and at least one power cord adapter electrically coupled to said switches for allowing a user to electrically connect said apparatus to alternate ones of the external power sources;

wherein said lens is bifurcated and includes integrally connected surfaces diametrically offset from each other, said lens further includes a lever extending outwardly therefrom for allowing a user to readily position said lens along a selected arcuate path about the axis and adjust the luminescence intensity emitted from said apparatus.

12. The apparatus of claim 11, further comprising: an elongated handle integral with said housing and axially extending downwardly and away therefrom for providing a surface onto which a user may grip said apparatus when transporting said housing between remote locations, said handle being provided with a conduit axially formed therein and in fluid communication with another of said partitions for directing said at least one power cord adapter upwardly towards said light-emitting sources.

13. The apparatus of claim 11, further comprising: a magnetic strip inconspicuously positioned within another said housing wall so that a user can removably position said apparatus at an elevated position without employing at least one of said hook members.

14. The apparatus of claim 11, wherein said at least one power cord adapter comprises: a power cord selected from the group including a 110-volt power cord, a 12-volt cigarette lighter power cord, a vehicle battery power cord adapter provided with a plurality of conductive clamps engageable with positive and negative battery terminals respectively, and any combination of said power cords.

15. The apparatus of claim 11, wherein one of said hook members is adjustably connected to said housing so that a user can swivel said housing along a radial path.

* * * * *